US005610634A

United States Patent [19]

Murata et al.

[11] Patent Number: 5,610,634

[45] Date of Patent: Mar. 11, 1997

[54] RECORDING APPARATUS

[75] Inventors: Takayuki Murata, Kawasaki; Hiroshi Fukui, Yokosuka; Shinichi Omo, Yokohama; Akira Kuronuma, Kawasaki, all of Japan

[73] Assignee: Canon Kabushiki Kaisha, Tokyo, Japan

[21] Appl. No.: 165,846

[22] Filed: Dec. 14, 1993

[30] Foreign Application Priority Data

Dec. 17, 1992 [JP] Japan ..... 4-337397

[51] Int. Cl.[6] ..... B41J 29/38

[52] U.S. Cl. ..... 347/5; 347/41; 395/115

[58] Field of Search ..... 347/5, 12, 13, 347/15, 41; 395/114, 115, 116, 250, 113; 358/412, 413, 414, 418

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 4,967,203 | 10/1990 | Doan et al. | 347/41 |
| 5,029,327 | 7/1991 | Nureki | 364/519 |
| 5,032,923 | 7/1991 | Kurtin et al. | 358/296 |
| 5,093,904 | 3/1992 | Sasaki et al. | 395/116 |
| 5,150,455 | 9/1992 | Morikawa et al. | 395/114 |
| 5,163,123 | 11/1992 | Kadono | 395/116 |
| 5,430,469 | 7/1995 | Shioya et al. | 347/15 |

FOREIGN PATENT DOCUMENTS

| | | |
|---|---|---|
| 5456847 | 5/1979 | Japan . |
| 59-123670 | 7/1984 | Japan . |
| 59-138461 | 8/1984 | Japan . |
| 6071260 | 4/1985 | Japan . |
| 2202662 | 9/1988 | United Kingdom . |
| WO8303487 | 10/1983 | WIPO . |

*Primary Examiner*—John E. Barlow, Jr.

*Attorney, Agent, or Firm*—Fitzpatrick, Cella, Harper & Scinto

[57] ABSTRACT

A recording head having a plurality of recording elements arranged thereon is scanned in a direction different from the direction of arrangement of the recording elements to effect a main scan. The scan is started when one scan of print data is stored in a buffer memory. Further, when a predetermined time has elapsed before one scan of print data is stored in the buffer memory, the scan is started without waiting for the storage of one scan of data and the data currently stored in the buffer memory is recorded. After the scan, a sheet is fed in accordance with the amount of print data recorded. The buffer memory can be effectively utilized without regard to a processing speed and a data transfer rate of a host apparatus.

9 Claims, 18 Drawing Sheets n-TH SCAN (n+1) TH SCAN

| FIG. 17A | FIG. 17B |
|---|---|

RECORDING APPARATUS

BACKGROUND OF THE INVENTION

1. Field of the Invention

The present invention relates to a recording apparatus for recording an image on a recording medium in accordance with print data.

2. Related Background Art

A serial type recording apparatus which prints data transferred from a host apparatus on a recording medium has been known. Such a recording apparatus records on the recording medium in accordance with a print command from the host apparatus. Accordingly, when a print speed of the recording apparatus is sufficiently high, a processing speed of the host apparatus becomes critical.

In the serial type recording apparatus, the printing is not started unless one line of data along a scan direction is stored. As a result, if a print data transfer rate changes line by line, a data buffer in the recording apparatus may not be effectively used.

In a color output recording apparatus which has recently been becoming popular rapidly, print data is of huge volume and the low processing speed of the host apparatus and the low data transfer rate are raising a serious problem.

In a recording head having a plurality of recording elements integrally arranged (hereinafter referred to as a multi-head) to improve a recording speed, it is common to provide a plurality of integrally arranged ink discharge orifices and liquid paths, and to arrange a plurality of such multi-heads to comply with a color requirement.

In printing a high resolution monochromatic image or color image, various factors such as coloration, tonality (or gradation) and uniformity should be considered. As to the uniformity, a slight variation from nozzle to nozzle which is caused during the manufacturing process of the multi-head may affect the amount of discharge of ink by the nozzle and the direction of discharge and it finally appears as a scatter of the density of the printed image, which results in the degradation of the image quality. To solve the problem of scatter of density, it has been proposed to print a print area, which may normally be printed in one scan, in a plurality of scans and feed a sheet for each scan (for example, U.S. Pat. No. 4,967,203).

For example, the printing in a first scan is effected while a lower half of a print head is used for a predetermined print area on a record sheet and a mask of zig-zag pattern (or checker flag pattern) is applied to the print data. Then, the sheet is fed by one half of the print head. Then, the printing in a second scan is effected while an upper half of the print head is used and a mask of a complementary zig-zag pattern (or reverse checker flag pattern) is applied with the print data (hereinafter referred to as split recording). By this recording, the affect by the nozzle to produce nozzle scatter of the print head at the designated print area is minimized.

However, since the recording is effected by discharging the ink in the ink jet recording apparatus, the tint may differ between the recording on a dry record sheet and the printing on a wet record sheet. Particularly in the split recording as described above in which one print area is printed in a plurality of scans, the ink is discharged on the wet sheet ink in a second scan.

The recording apparatus usually records on a recording medium by a print command from the host apparatus. Accordingly, when the print speed of the recording apparatus is sufficiently high, the processing speed of the host apparatus becomes critical. If the print data processing speed and the data transfer speed of the host apparatus are lowered in the course of printing, the ink printed in the previous scan is dried and the tint may differ from that of the printing effected before drying and the scatter of density appears in the print and high quality printing is not attained.

SUMMARY OF THE INVENTION

It is an object of the present invention to provide an improved recording apparatus in view of the problems described above.

It is another object of the present invention to provide a recording apparatus which can effectively utilize storage means for storing print data irrespective of a processing speed and a data transfer rate of a host apparatus.

It is still another object of the present invention to provide a recording apparatus which can attain high quality recording irrespective of the processing speed and the transfer rate of the host apparatus.

It is still another object of the present invention to provide a recording apparatus which effects the recording of a predetermined amount of data when the predetermined amount of data is stored in storage means, and effects the recording of a smaller amount of data than the predetermined amount even before the storage of the predetermined amount of data if a predetermined time has elapsed so that the storage means for storing the print data is effectively utilized.

If is a further object of the present invention to provide a recording apparatus which effects the printing without waiting for the storage of a predetermined amount of data even if the transfer of print data is delayed in the split recording so that the scatter of density due to the change in the time between the record scans is prevented and a high quality of image is attained.

The above and other objects of the present invention will be apparent from the drawings and the following description.

DETAILED DESCRIPTION OF THE PREFERRED EMBODIMENTS

First Embodiment

Figure 1:
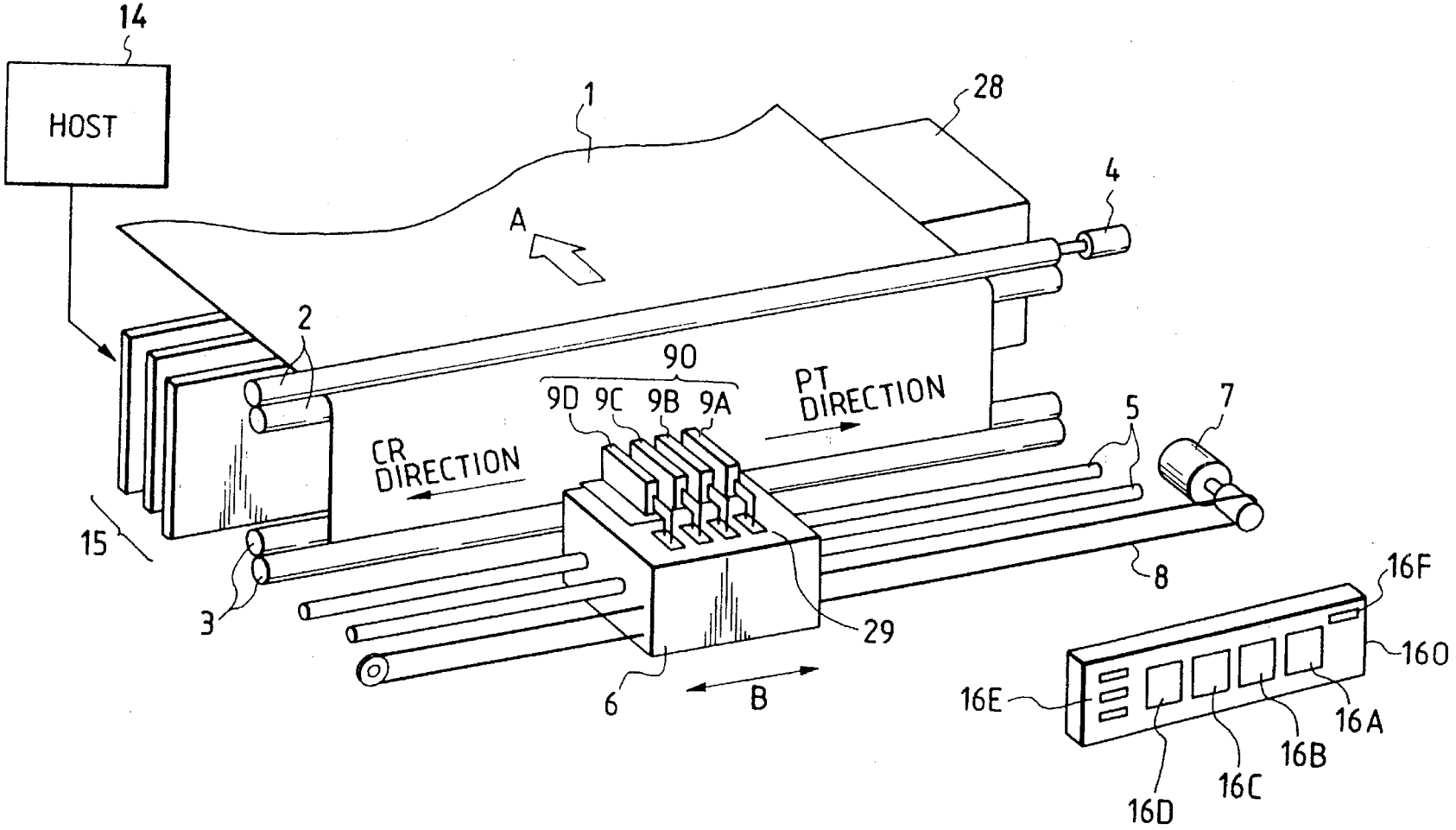
FIG. 1 shows a perspective view of a main part of a color ink jet recording apparatus to which the present invention is applicable.

FIG. 1 shows a construction of a color ink jet recording apparatus which has an electro-thermal transducer as discharge energy generation means and causes a change of state of ink by using a thermal energy generated by the electro-thermal transducer to discharge the ink.

In FIG. 1, a recording medium 1 such as a paper or plastic sheet is supported by a pair of transport rollers 2 and 3 arranged above and below a record area and it is transported in a direction of an arrow A by the transport roller 2 driven by a sheet feed motor 4. A guide shaft 5 is provided in front of the transport rollers 2 and 3 in parallel thereto. A carriage 6 is reciprocally moved in a direction of an arrow B along the guide shaft by an output of a carriage motor 7 through a wire 8.

A recording head 90 which is an ink jet head of a type which discharges ink by using the thermal energy is mounted on the carriage 6 which serves as head drive means. The recording head 90 is for color image recording and arranged in a scan direction of the carriage, and comprises four recording heads 9 provided for each of colors cyan (C), magenta (M), yellow (Y) and black (Bk), that is, a black head 9A, a cyan head 9B, a magenta head 9C and a yellow head 9D. An ink discharge unit having a plurality of (for example, 48 or 64) ink discharge orifices arranged in a vertical line which traverses the direction of scan of the carriage is provided on a front plane of each of the recording heads 9, that is, the plane facing a record plane of the recording medium 1 with a predetermined spacing (for example, 0.8 mm) therebetween.

Figure 2:
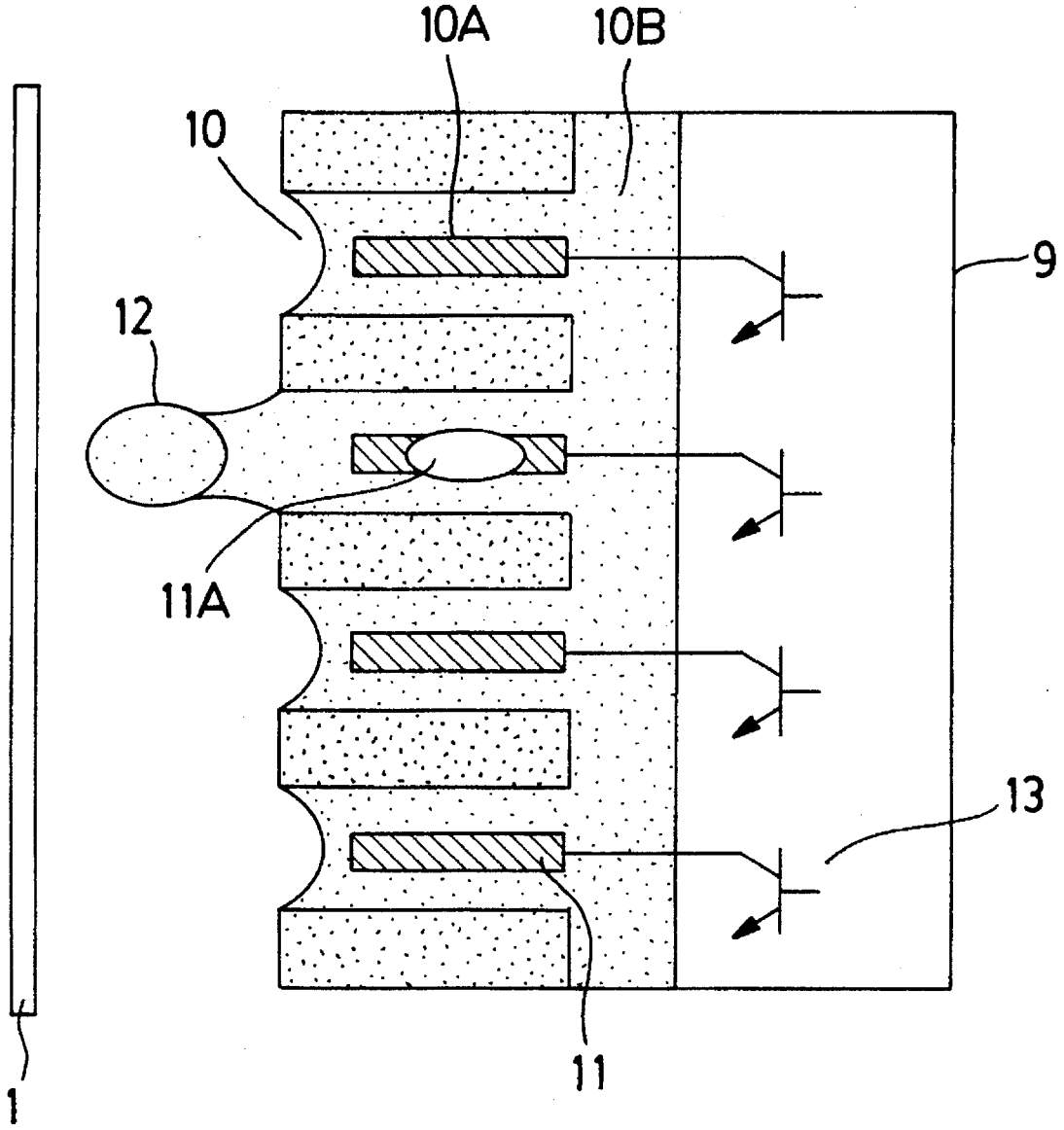
FIG. 2 shows a sectional view for illustrating an ink jet recording head to which the present invention is applicable.

FIG. 2 shows a longitudinal sectional view of a portion of the ink discharge unit of the recording heads 9 (the recording heads 9A–9D being of the same construction).

In FIG. 2, a plurality of ink discharge orifices 10 are formed vertically at a predetermined pitch on a plane facing the recording medium 1, and an electro-thermal transducer (such as a heat generating resistor) 11 provided for each ink discharge orifice 10 is driven (energized) in accordance with record information to cause a film boiling phenomenon in the ink to generate bubbles 11A, and the ink is discharged by a resulting pressure to form flying ink droplets 12 so that the ink droplets are deposited on the recording medium 1 in a predetermined pattern to attain recording by a dot pattern.

A heat driver 13 for energizing and deenergizing the electro-thermal transducer is provided for each of the recording heads 9A–9D, and a circuit board for a driver 29 therefor is provided on the carriage 6. Numeral 10A denotes a liquid path and numeral 10B denotes a common liquid chamber.

A control unit including an engine control circuit (CPU) of the recording apparatus and associated ROM and RAM receives a command signal and a data signal (record information) from a controller 14 of a host apparatus, and applies a drive power supply (heat power supply) for the electro-thermal transducer to the respective recording heads 9A to 9D through a drive circuit 29 and the heat driver 13, together with drive sources for various motors in accordance with the received signals.

Keys including an on-line/off-line selection switch 16A, a line feed key 16B, a form feed key 16C and a record mode selection key 16D and a display unit including an alarm lamp 16E and a power lamp 16F are provided on a console panel 160 (FIG. 1) mounted on an outer case (not shown) of the recording apparatus.

Figure 3:
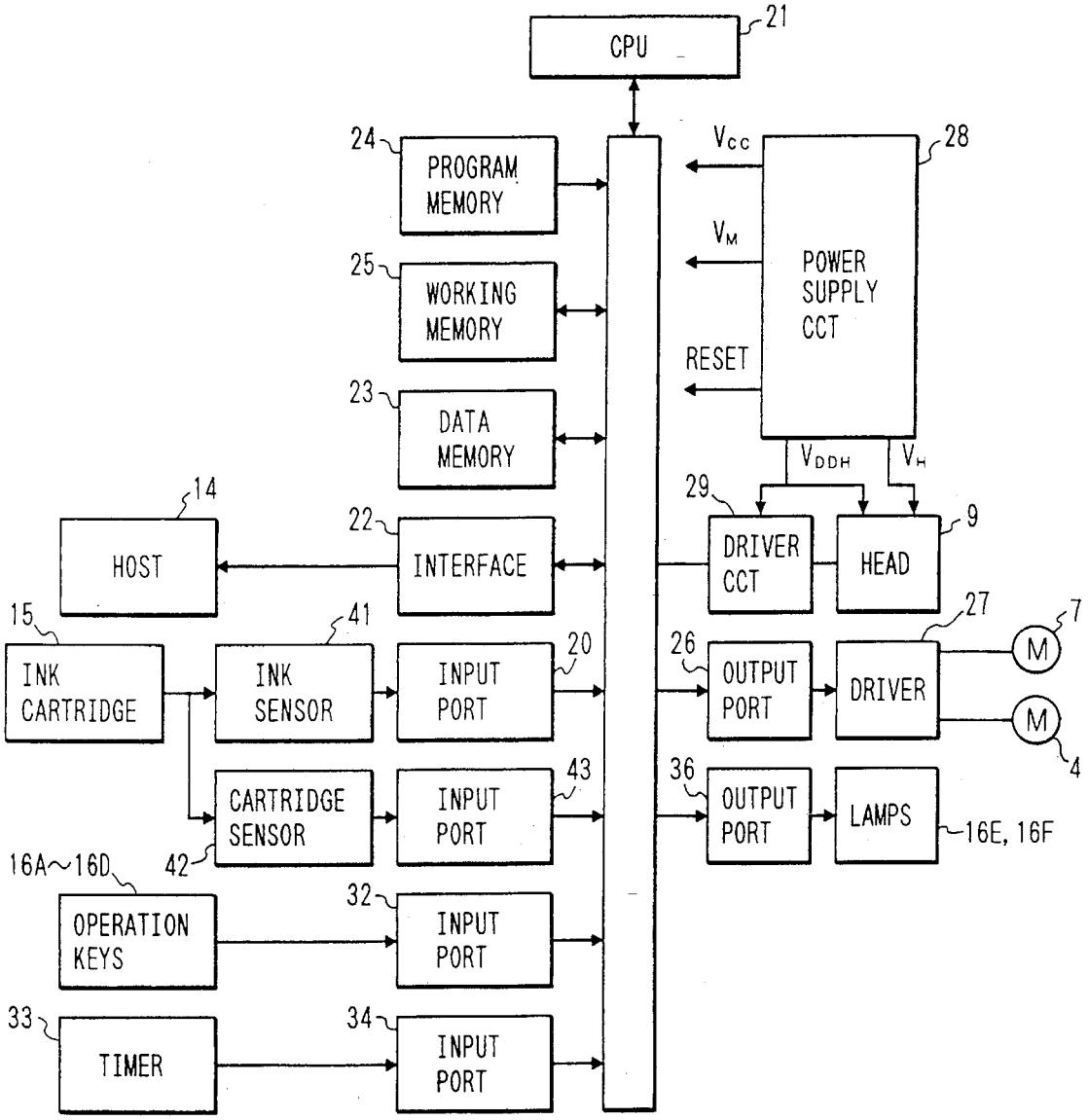
FIG. 3 shows a block diagram of a control unit of a color ink jet recording apparatus.

FIG. 3 shows a block diagram of a control unit of the color ink jet recording apparatus shown in FIG. 1.

In FIG. 3, a CPU 21 in a form of a microprocessor is connected to the host apparatus 14 through an interface 22 and controls the recording operation in accordance with a command signal and a record information signal read into a data memory (buffer) 23 from the controller of the host apparatus 14 and a program and print command data stored in a program memory 24 in a form of ROM and a working memory 25 in a form of RAM.

The CPU 21 controls the carriage motor 7 and the sheet feed motor 4 through an output port 26 and a motor driver 27, and controls the recording head 9 through a head control circuit 29 in accordance with the record information stored in the data memory 23 to record the data.

The outputs from the keys 16A to 16D (FIG. 1) on the console panel 160 are sent to the CPU 21 through an input port 32, and control signals are supplied through an output port 36 for the alarm lamp 16E and the power lamp 16F.

Numeral 33 denotes a timer arranged on the control circuit board and it is connected to an interrupt port of the CPU 21 through an input port 34.

In FIG. 3, a power supply circuit 28 outputs a logic drive voltage VCC (e.g. 5 volts), a motor drive voltage VM (e.g. 30 volts), a reset voltage RESET, a heat voltage VH (e.g. 25 volts) for energizing the electro-thermal transducer 11 of the recording head 9 for generating a heat, and a back-up voltage VDDH for protecting the recording head 9.

The heat voltage VH is applied to the recording head 9, and the back-up voltage VDDH to the head control circuit 29 and the recording head 9. Numeral 15 denotes an ink cartridge for storing ink to be supplied to the respective recording heads 9A–9D, numeral 41 denotes a sensor for detecting the presence or absence of the ink in the ink cartridge 15, and numeral 42 denotes a sensor for detecting the presence or absence of the ink cartridge 15.

The present invention is now explained in detail by using the ink jet recording apparatus of the above construction.

Figure 5:
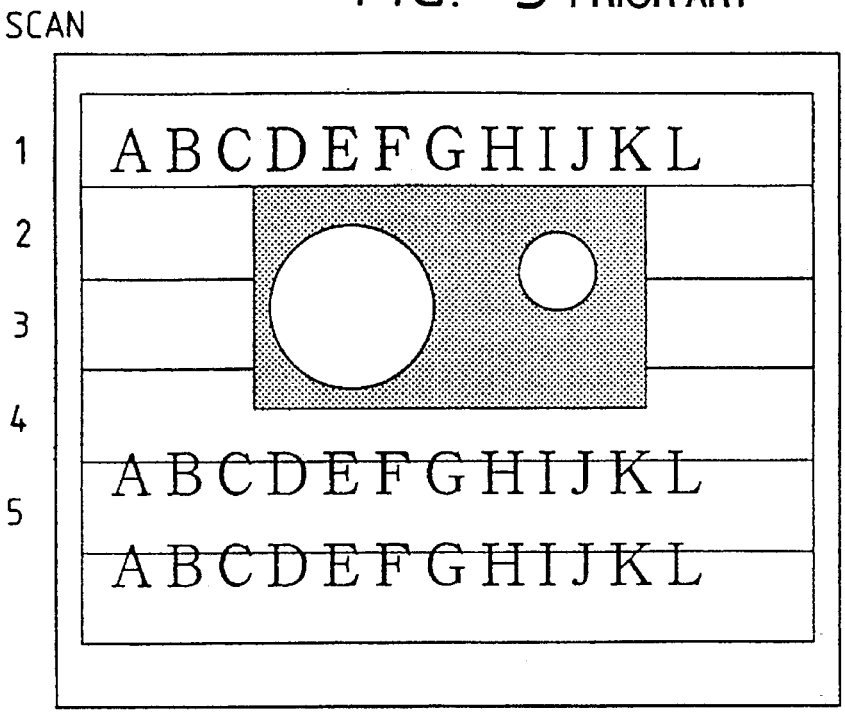
FIG. 5 PRIOR ART
FIG. 5 shows a printout by a prior art printing method.

FIG. 5 shows a printout printed by a prior art printing method. Print data is sent from the host apparatus 14 through the interface 22. In the print data of FIG. 5, a first scan is for character data, a second scan, a third scan and a portion of a fourth scan are for graphic image, and the remaining portion of the fourth scan to a portion of a sixth scan are is for character image.

In the host apparatus, the data processing of the graphic data usually takes a longer time for data processing and development than the data processing of the character image. On the other hand, in the recording apparatus, the processing time and the printing time for the received image data are same for the characters and the graphics.

Noticing to the fourth scan, a portion thereof is for the graphic image data which requires a long time to transfer the data and the remaining portion is for the character data which does not take a long time. By printing the graphic image data of the fourth scan first and releasing the data memory 23 for the subsequently transmitted data, the data memory 23 can be effectively utilized for the character data which is transmitted at a higher rate so that rapid printing can be attained.

Figure 6:
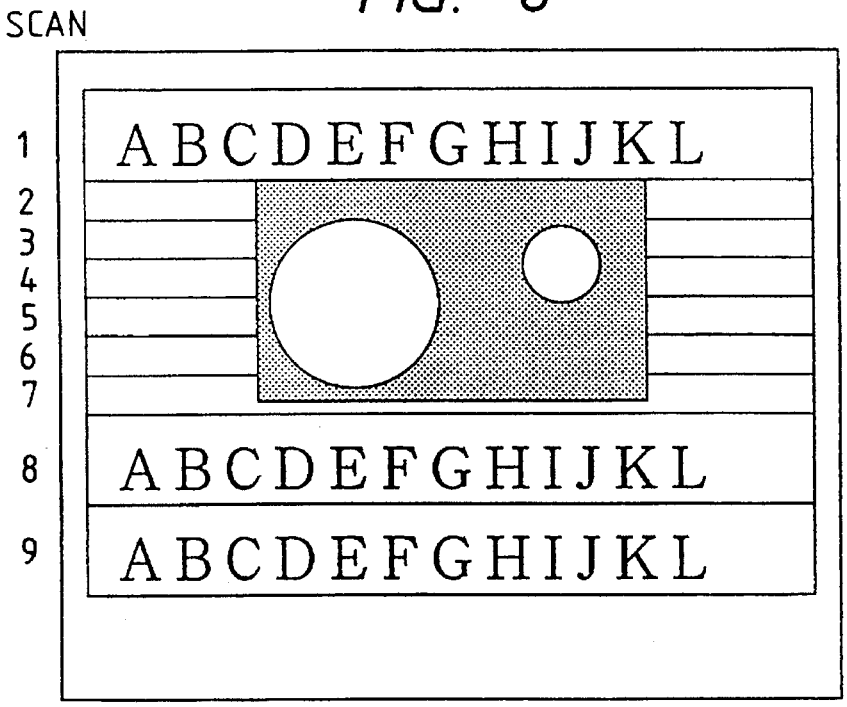
FIG. 6 shows a printout by the first embodiment of the present invention.

FIG. 6 shows a printout printed by the printing method in accordance with the present invention. The print data sent from the host apparatus is same as the print data of FIG. 5. In the present method, when the transmission time of one scan of print data from the host apparatus exceeds a predetermined time which is monitored by a timer 33, the printing is effected without waiting for the storage of one scan of print data.

In FIG. 6, the first scan of character data is printed without regard to the timer 33 because the host apparatus rapidly transfer the print data. However, since the host apparatus takes a long time for the image development and the transfer of the graphic image data of the second scan to the seventh scan, the printing is automatically effected when the time set by the timer has elapsed regardless of the storage of one scan of data in the data memory 23. As a result, the character image data which is relatively rapidly sent in the eighth scan can be effectively developed in the data memory 23 which has been released from the previously printed graphic image data, and the print processing time of the overall recording apparatus is reduced.

Figure 4:
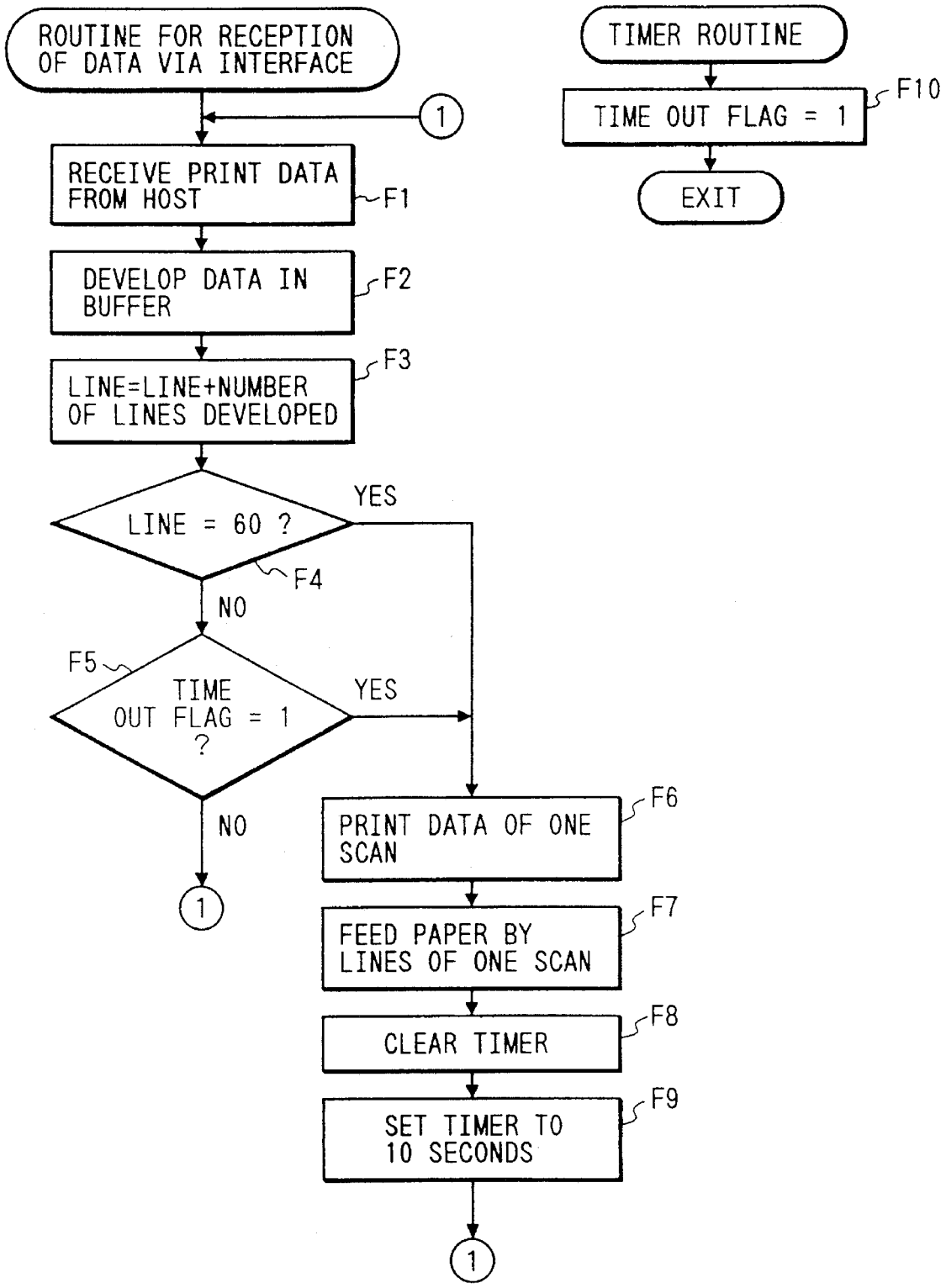
FIG. 4 shows a control flow chart of a first embodiment of the present invention.

The print control of the present invention is explained with reference to a control flow chart of FIG. 4. After the initialization of the recording apparatus, an interface data receive routine shown in FIG. 4 is started. In the interface data receive routine, the print data sent from the host apparatus 14 through the interface 22 is received (F1) and the print data is developed into the data memory 23 by the CPU 21 (F2). The number of lines stored of the developed print data is stored in the working memory 25 (memory area LINE) (F3). Then, whether the developed data has been stored by one scan (60 lines in the present embodiment) or not is determined (F4), and if one scan of data has been stored, it is printed by one scan (F6). After the printing, the sheet is fed by the number of printed lines, that is, by one scan (F7) to be ready for the next printing. Since the printing is effected earlier than the time set in the timer 33, the timer is cleared (F8) and the predetermined time is set again (F9) (10 seconds in the present embodiment).

When a predetermined signal is applied from the timer 33 to the interrupt port, the CPU 21 executes a timer routine. In the time routine, a time-out flag is set when the preset time (10 seconds) is elapsed (F10). When the flag is set during the reception of the data from the interface (F5), the printing is effected for the received lines even if the received print data does not reach one scan (60 lines) (F6). After the printing, the sheet is fed by the number of printed lines to be ready for the next printing. The timer is cleared (F8), the time-out flag is reset and the timer is set again to the predetermined time (F9).

By the above operation, the data buffer of the recorder can always be released for reuse without regard to the speed of the processing time and the print data transfer time of the host apparatus.

Embodiment 2

Figure 7:
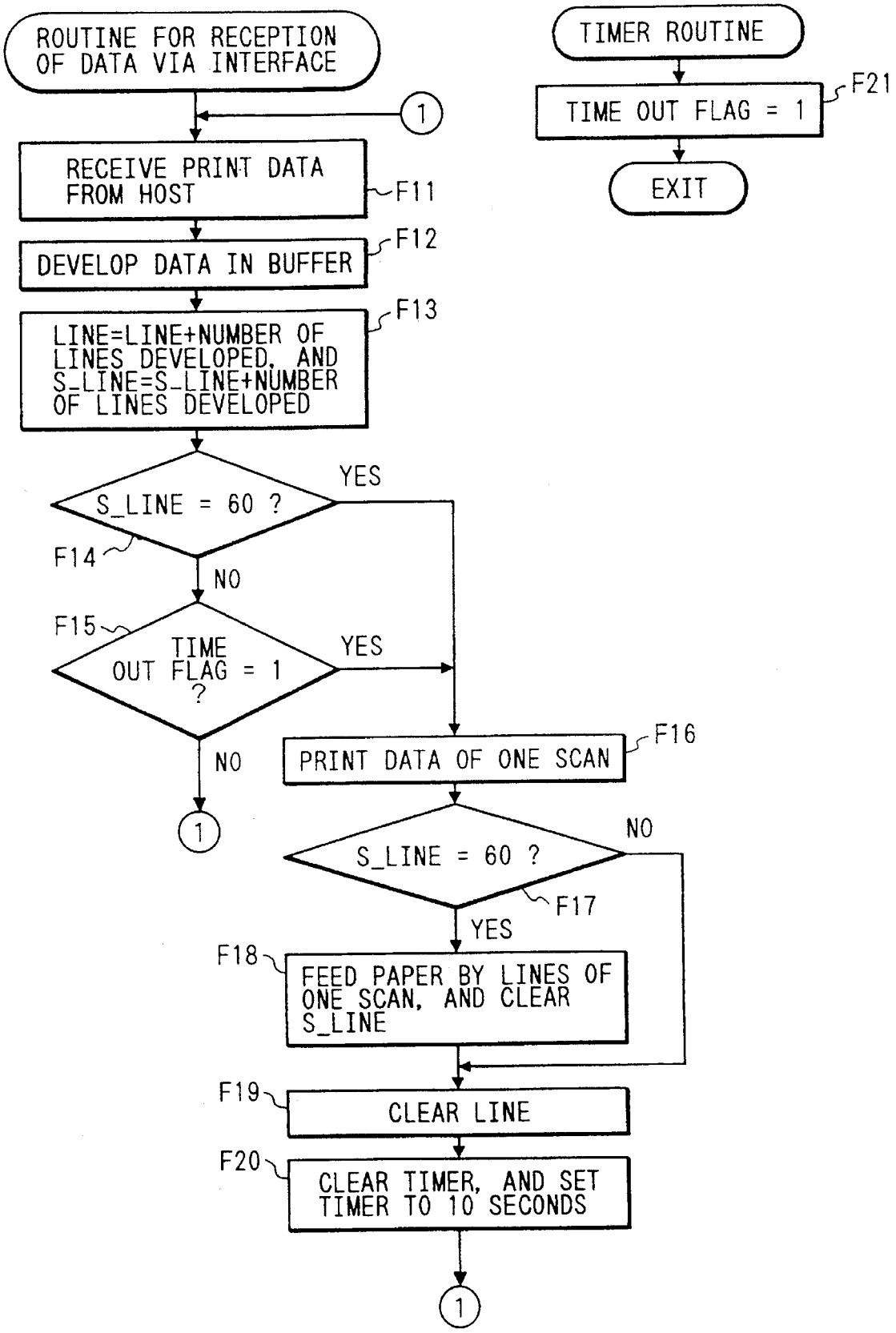
FIG. 7 shows a control flow chart of a second embodiment of the present invention.

A second embodiment of the present invention is now explained by using a control flow chart of FIG. 7. In the present embodiment, the printing is effected at a constant time interval by a timer interruption without regard to the transfer rate of the host apparatus but the sheet feed is effected after the printing of one scan.

First, when the initialization of the recording apparatus is completed, an interface data receive routine shown in FIG. 7 is started as it is in the embodiment 1. In the interface data receive routine, the print data sent from the host apparatus 14 through the interface 22 is received (F11) and the print data is developed into the data memory 23 by the CPU 21 (F12). The number of lines of the developed print data is stored in the working memory 25 and the number of lines printed before the sheet feed is stored in a S_LINE (F13). Whether the developed data has reached one scan (60 lines in the present embodiment) or not is determined (F14), and if it reaches one scan, the one scan is printed (F16). After the printing, whether the printing has been effected for the number of lines printed after the previous sheet feed, that is, 60 lines or one scan as stored in the S_LINE or not is determined (F17), and if one scan has been printed, the sheet is fed by 60 lines (F18) and the number of printed lines LINE is cleared (F19). Since the printing is effected earlier than the time set in the timer 33, the timer is cleared and the predetermined time is set again (10 seconds in the present embodiment) (F20).

When a predetermined signal is applied from the timer 33 to the interrupt port, the CPU 21 executes a timer routine. In the timer routine, when the preset time (10 seconds) is elapsed, a time-out flag is set (F21). If the flag is set during the reception of the data from the interface (F15), the received lines are printed even if the received lines of the print data do not reach one scan (F16). If the sheet was not fed in the previous printing, the print data for the ink discharge unit of the recording head 9 is staggered accordingly so that the printing is made in the correct area. This may be attained by controlling the print data to the head 9. After the printing, the sheet is not fed because the number of printed lines S_LINE after the previous sheet feed does not reach one scan (F17). The timer is cleared, the time-out flag is reset and the timer is set again to the predetermined time (F20).

By the above operation, the data buffer of the recording apparatus may always be released for reuse without regard to the speed of the processing time and the data transfer rate of the host apparatus and without increasing the number of times of sheet feed.

Embodiment 3

A third embodiment of the present invention is now explained. In the present embodiment, the recording is completed in a plurality of scans by using different record areas of the recording head for a predetermined area on the recording sheet and sequentially using masks of complementary thinning patterns for the print data. A timer is provided in the recording apparatus, and if the transfer of the print data from the host apparatus takes a longer time than a predetermined time, the printing is effected without waiting for the transmission of one line of data, and the subsequent sheet feed is determined in accordance with the amount of print and the printing is effected without regard to the speed of the processing and development of the print data and the data transfer rate of the host apparatus so that the print interval between the first scan and the second scan is always kept constant and the degree of dry of the sheet at the printing in the second scan is kept constant. In this manner, the scatter of density in the printout is eliminated.

The present embodiment is explained in detail. The construction of the recording apparatus in the present embodiment is same as that of FIGS. 1 and 2 and the construction of the control unit is same as that of FIG. 3, and the explanation thereof is omitted.

Figure 8:
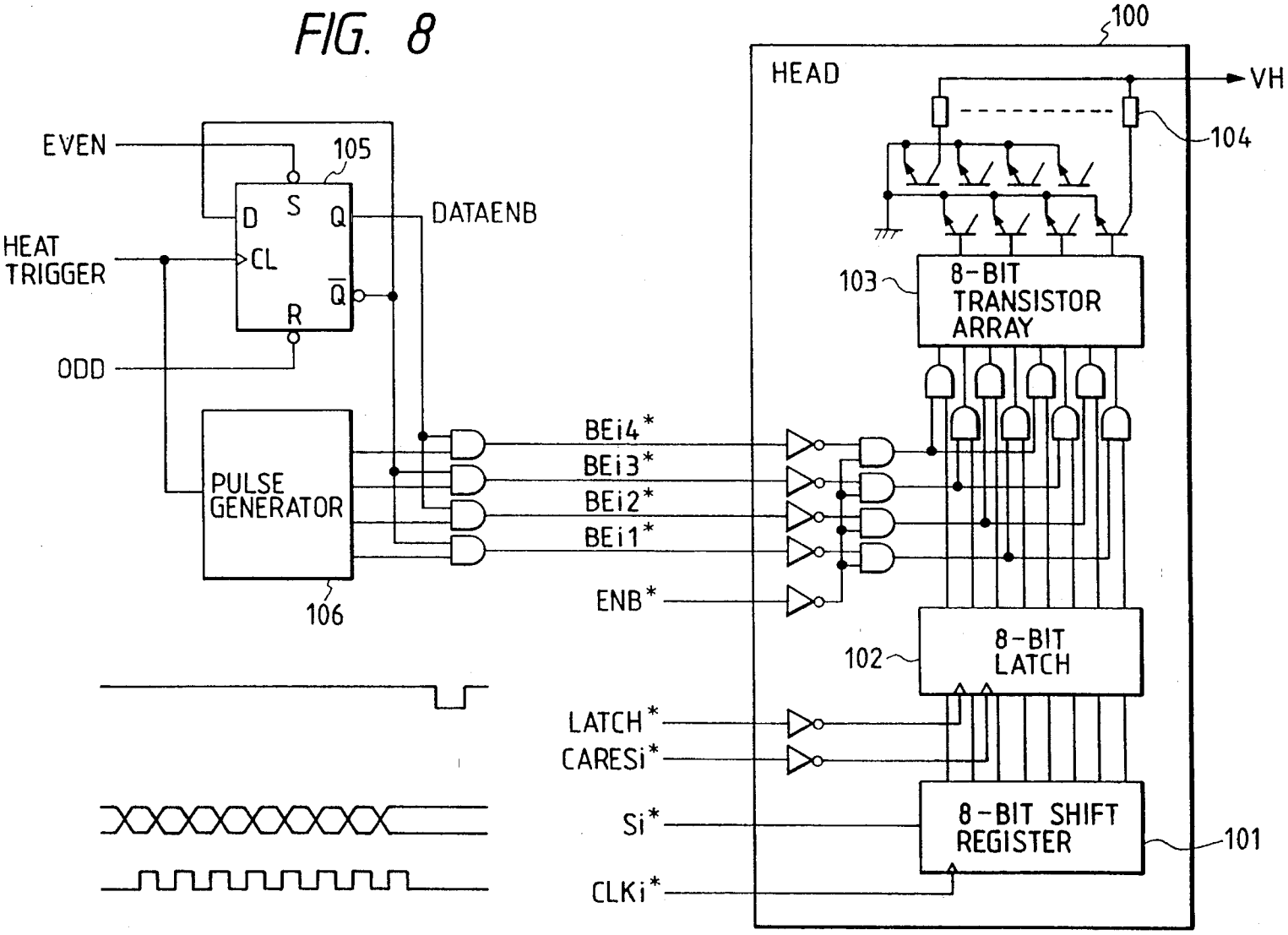
FIG. 8 shows a circuit diagram for effecting zig-zag and complementary zig-zag printing, FIGS. 9(*a*) through 9(*i*) show a timing chart for effecting the zig-zag and complementary zig-zag printing, FIGS. 10(*a*) and (*b*) show a printout by multi-path printing.
Figures 9A, 9B, 9C, 9D, 9E, 9F, 9G, 9H, 9I:
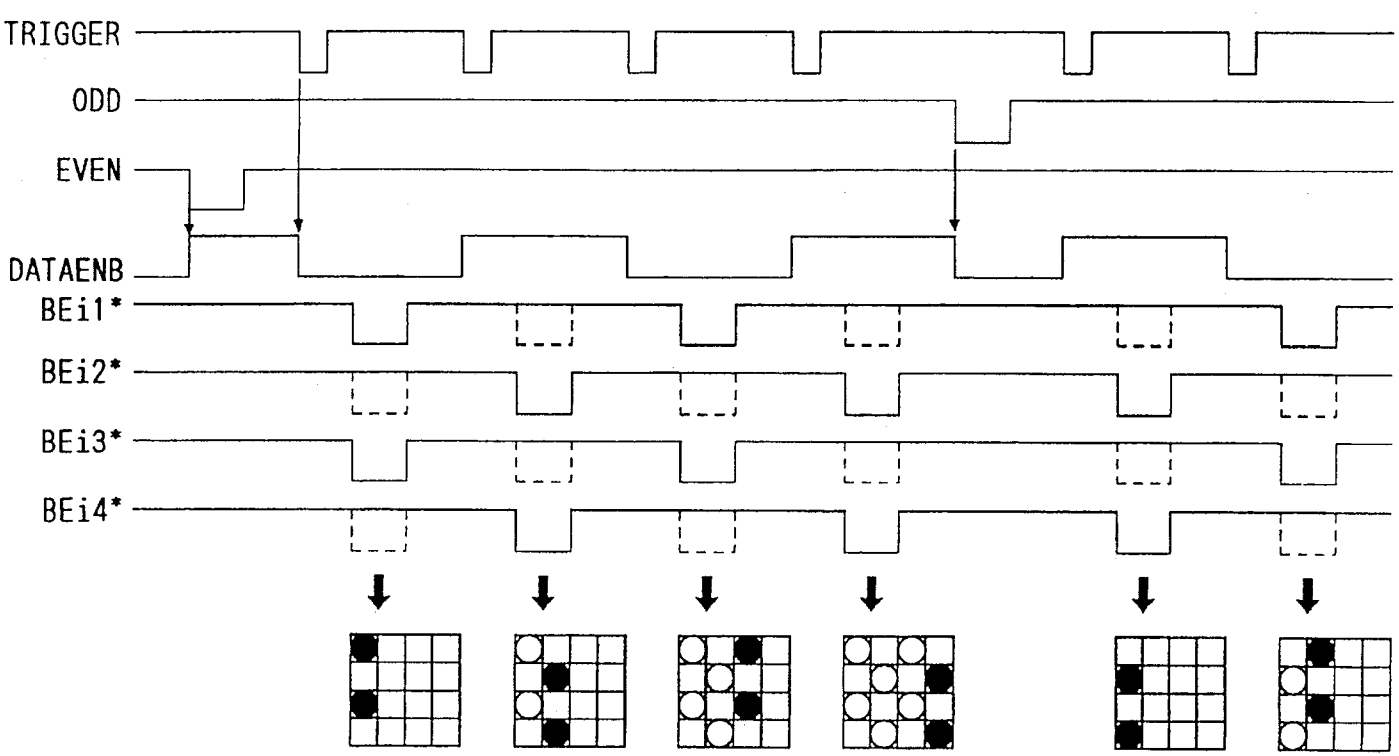

FIG. 8 shows a block diagram of an electrical configuration of a head driver and a head for effecting zig-zag and complementary zig-zag thinning printing. FIGS. 9(*a*) through 9(*i*) show waveforms of signals on a circuit of FIG. 8.

In the present embodiment, a head having an eight-nozzle ink discharge port is used as a recording head.

A head unit 100 loads print data Si into an 8-bit shift register 101 by a print data synchronous clock CLKi and sets signals BEi1*, BEi2*, BEi3* and BEi4* to ON conditions, respectively, to drive a transistor array 103 of the head unit 100 and cause a heater 104 to generate heat for effecting the printing. A signal LATCH* is a control signal to latch the print data to a latch circuit 102, and a signal CARESi* is a reset signal to clear the latch. One heating is started by a signal Heat Trigger and a pulse generator 106 generates the signals BEi1*, BEi2*, BEi3* and BEi4*. Those signals may be staggered in time but they are shown to be outputted simultaneously for simplification purpose.

In order to effect the thinning, an output of a flip-flop 105 is switched by an input timing of the signal Heat Trigger so that the masking signal is alternately changed (for example, BEi1* and BEi3*) for each heating. As shown in a timing chart of FIG. 9, it is switched by High/Low of an output signal DATA ENB of the flip-flop 105. When the signal Heat Trigger is applied, the unmasked signal of the signals BEi1*, BEi2*, BEi3* and BEi4* is rendered low and the heater provided for the corresponding nozzle is energized so that the ink droplet is discharged. A broken line shows a mask timing which corresponds to the signal DATA ENB. Both EVEN signal and ODD signal are for initialization of the mask pattern. When the printing in the zig-zag pattern (or check flag pattern) is desired, the EVEN signal is sent prior to the printing of one line so that the flip-flop 105 is preset to enable the zig-zag printing. When the printing in the complementary zig-zag pattern (or reverse checker flag pattern) is desired, the ODD signal is sent so that the flip-flop 105 is set and the signals BEi2* and BEi4* are first turned on to allow the complementary zig-zag printing.

Figure 10A:
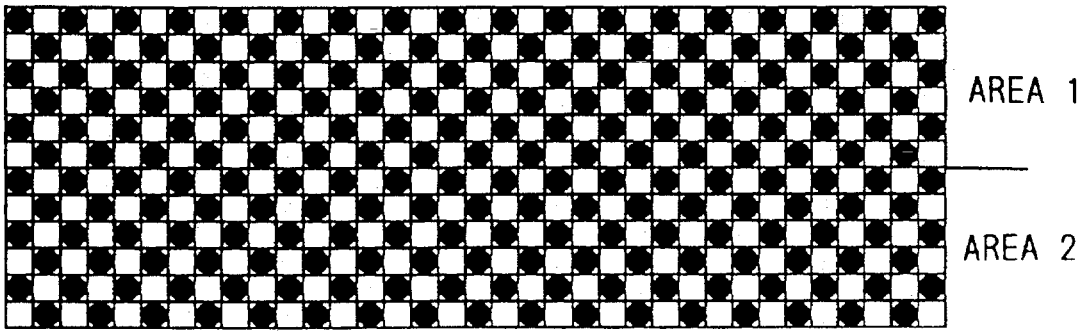
Figure 10B:
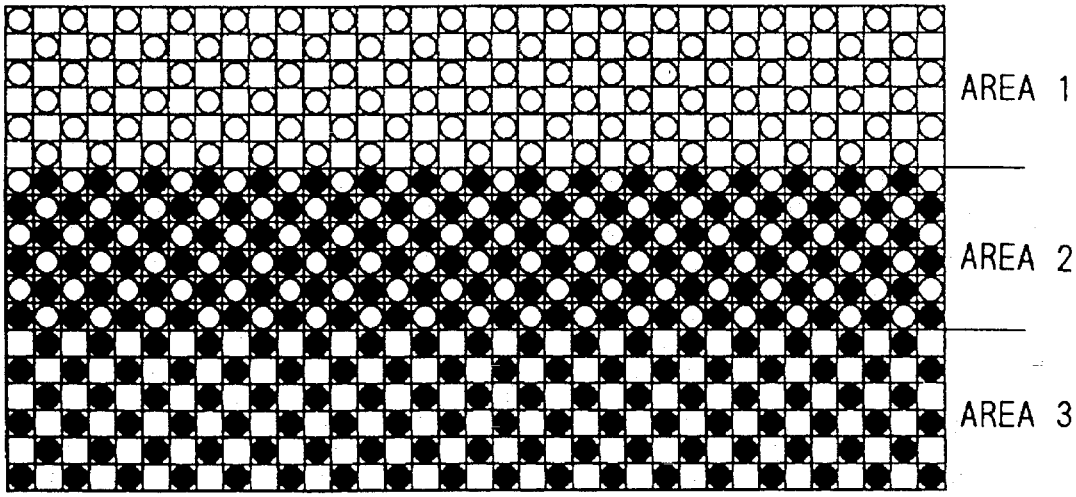

An actual print method is explained with reference to FIGS. 10(*a*) and (*b*). In FIGS. 10(*a*) and (*b*), one scan is represented by 12 vertical nozzles for simplification purpose. In an n-th scan, the zig-zag printing is effected in areas 1 and 2 by using the above circuit and the entire record area of the recording head in accordance with the print data transferred from the host apparatus. After the printing, the sheet is fed by one area, that is, one half of one scan width (6 nozzles). Then, the complementary zig-zag printing is effected in areas 2 and 3 by using the entire record area of the recording head in accordance with the print data. As a result, high grade printing is attained in the area 2 without the affect by the nozzle by nozzle scatter of the recording head.

Figure 11:
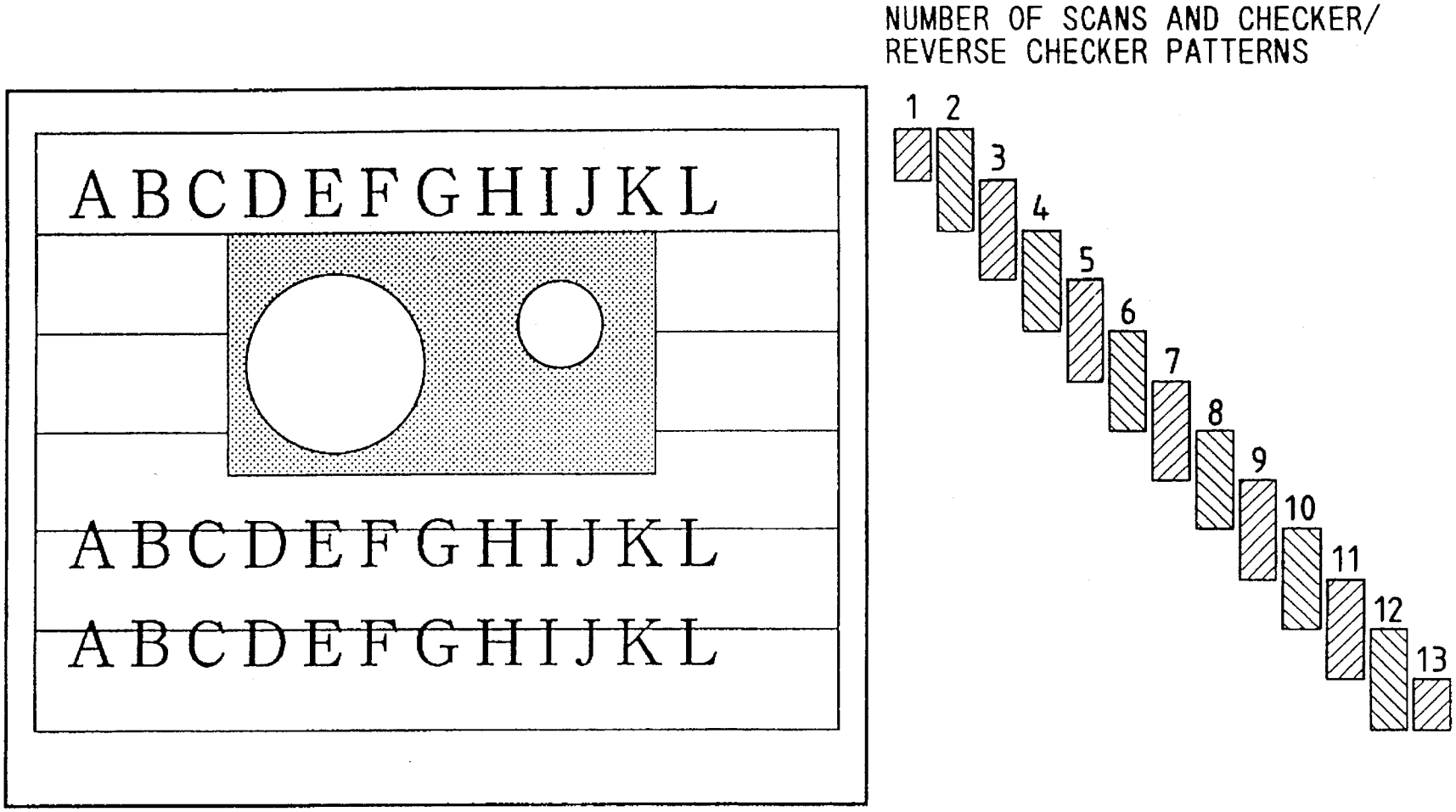
FIG. 11 shows a printout by a prior art zig-zag and complementary zig-zag printing method.

A recording operation in the actual printing is shown in FIG. 11. In FIG. 11, character image data and graphic image data are mixedly present. When this image is to be printed in the above print method, one half of the character image data is first zig-zag printed by using an upper half record area of the recording head (scan 1). Then, the character image data is complementary zig-zag printed by using the entire record area of the recording head (scan 2). Then, the zig-zag printing and the complementary zig-zag printing are alternately effected while the sheet is sequentially fed by one half of the scan width (scans 3 to 12). Finally, the zig-zag printing is effected by using a lower half recording area of the recording head (scan 13). In this manner, the print data is recorded on the record sheet.

However, in the host apparatus which transfers the print data, the graphic image data usually takes a longer time to process, develop and transfer than the character data. In the scans 1 and 2 of FIG. 11, the print data is transferred relatively quickly but the transfer of one scan of print data is delayed during the period in which the graphic image data is transferred (scans 3 to 7). As a result, in the scans 3 to 7, the ink discharged in one scan is dried on the sheet and the ink is discharged in the next scan on the dried ink. On the other hand, in the scans 1 and 2 and 8 to 13, the ink is discharged before the ink discharged in the previous scan is not yet dried. As a result, the density of the ink is different from that of the scans 3 to 7.

In the present embodiment, if one scan of print data is not sent from the host apparatus in the predetermined time, the printing is effected even if one scan of data is not stored so that the printing is effected in the same dry condition of ink discharged in the previous scan to keep the constant print density.

An actual printout in the present embodiment is explained with reference to FIG. 12.

Figure 12:
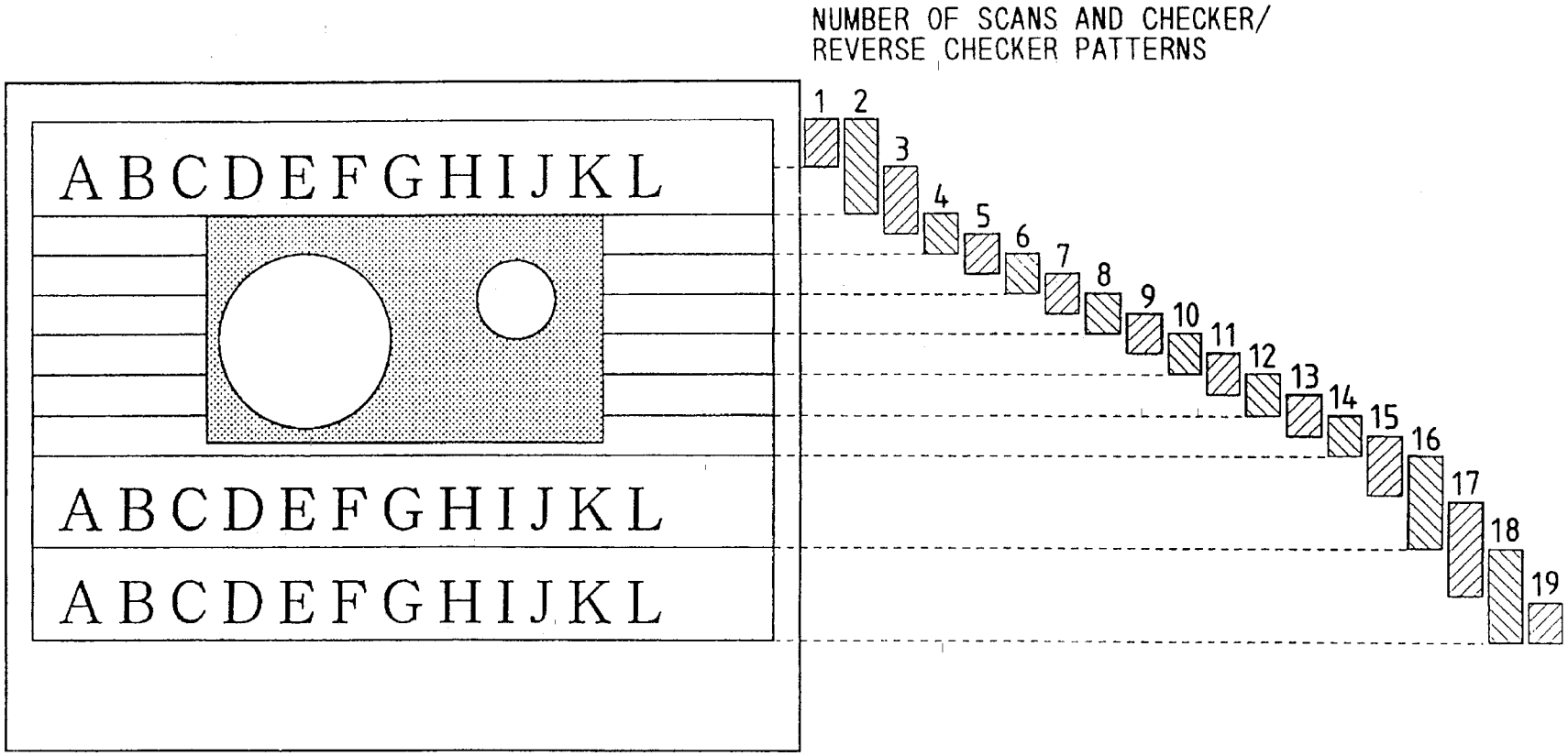
FIG. 12 shows a printout by zig-zag and complementary zig-zag printing in a third embodiment of the present invention.

In FIG. 12, the scans 1 and 2 are identical to those of FIG. 11. In the transfer of the graphic image data, if the transfer time of the host apparatus is longer than the predetermined time, the printing is started before one scan of print data is stored in the data memory 23 by the function of the timer 33. In this case, the print sequence of the zig-zag (or checker flag) and complementary zig-zag (or reverse checker flag) is maintained and the sheet feed width is one half of the print width. From the scan 15, the print data is the character image data and one scan of data is stored in the predetermined time. Thus, the print width is expanded.

Figure 13:
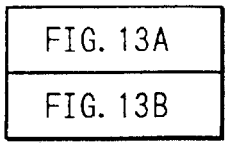
FIG. 13 is comprised of FIG. 13A and FIG. 13B showing control flow charts of the third embodiment, FIGS. 14(*a*) and (*b*) show a mask pattern used in a fourth embodiment of the present invention.
Figure 13A:
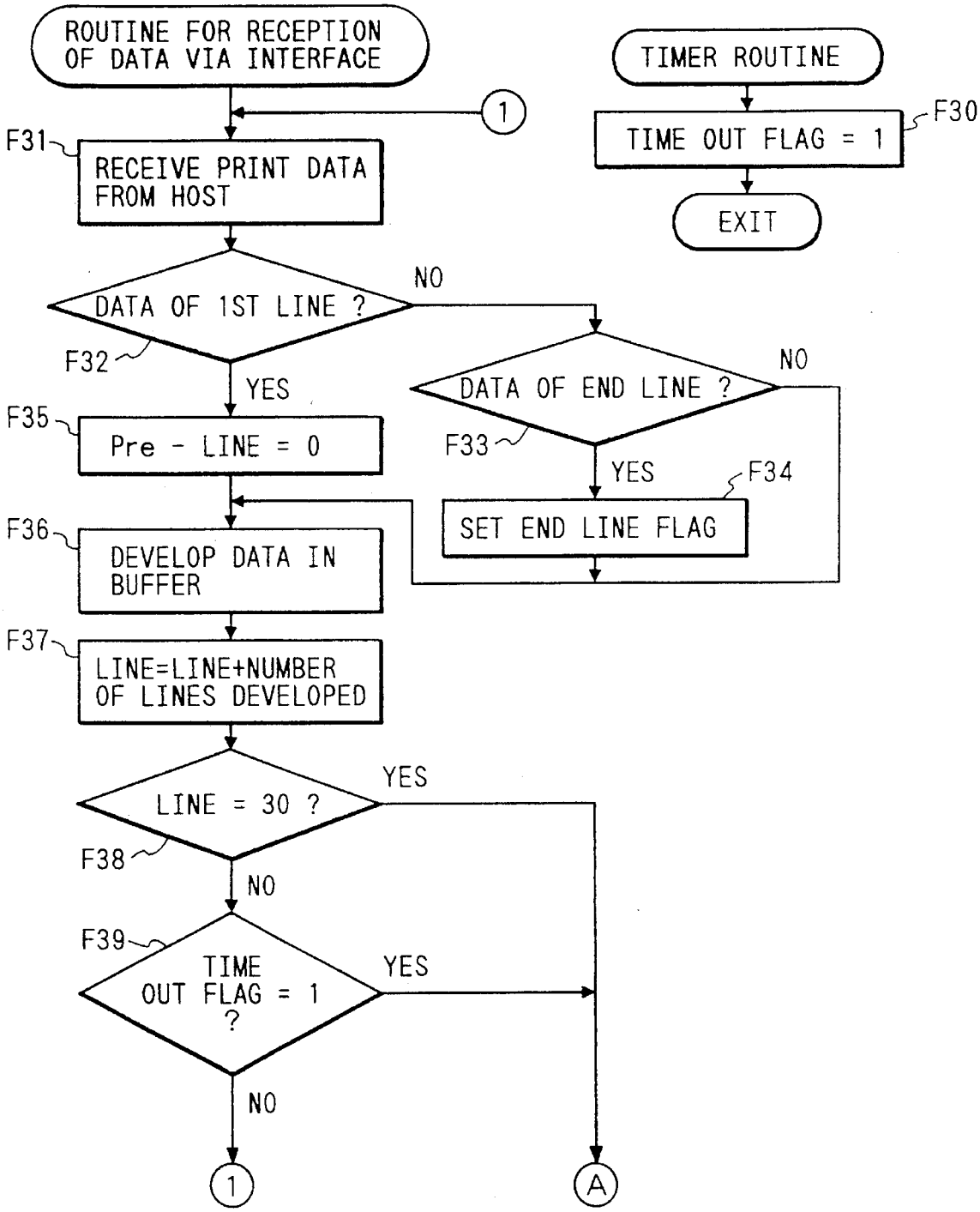
Figure 13B:
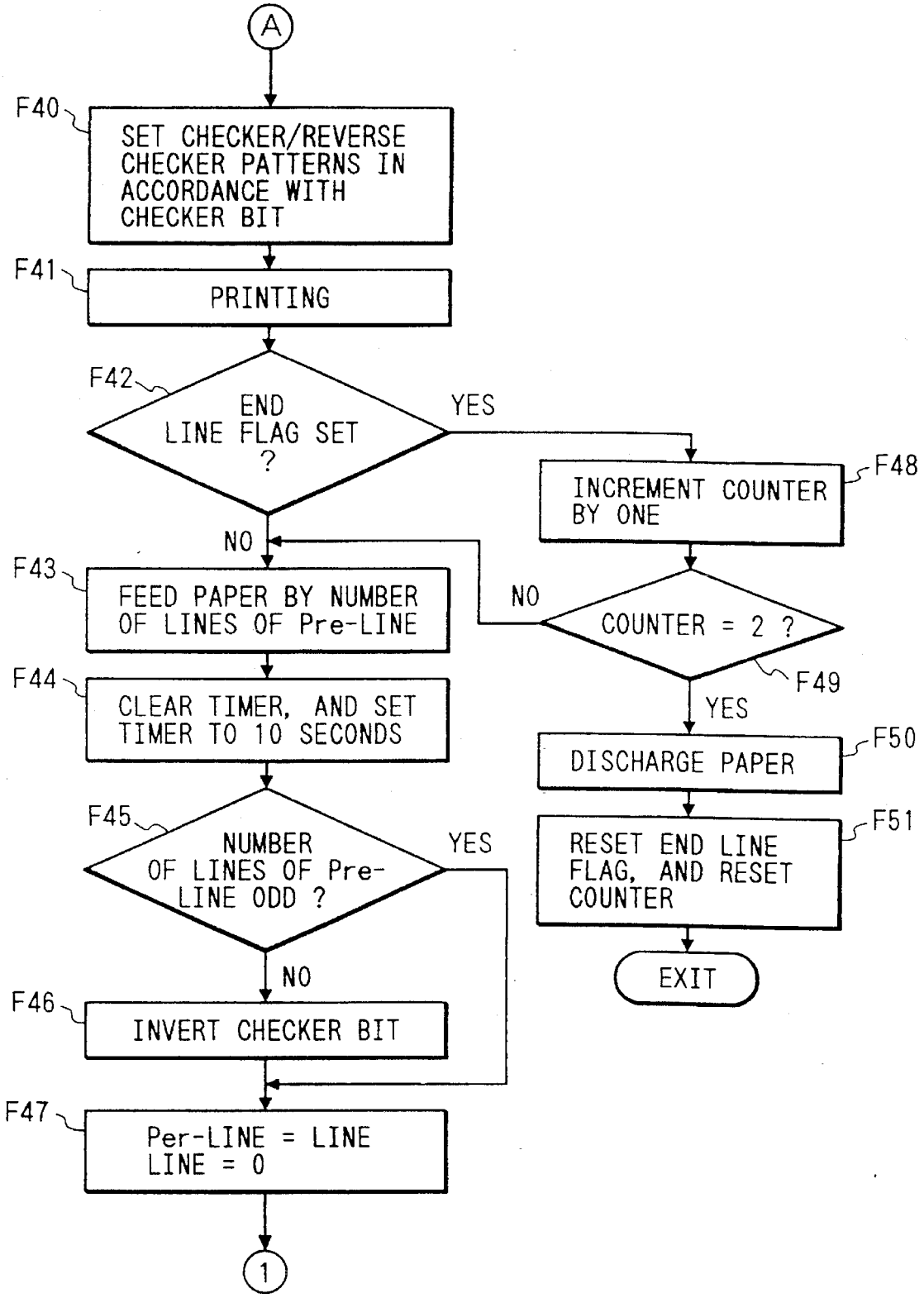

A control for effecting the above recording operation is explained with reference to flow charts of FIGS. 13A and 13B. After the initialization of the recording apparatus, the recording apparatus waits for the print data from the host apparatus. When it receives the print data from the host apparatus (F31), it determines whether it is the first line data or not (F32), and if it is, the content of a memory area Pre-LINE which is set in the working memory 25 for storing the number of lines previously developed is set to zero (F35). If it is not the first line data, it determines whether it is the last line data or not (F33), and if it is, a last line flag in the working memory 25 is set (F34). If it is not the last line data, the process proceeds to F36. In F36, the print data is developed into the data memory 23. The number of lines developed is stored in the memory area LINE in the working memory 25 (F37). When the developed print data reaches one half of scan (30 lines in FIG. 13A) (F38), the zig-zag print pattern (or checker flag pattern) or the complementary zig-zag pattern (or reverse checker flag pattern) is set in accordance with the zig-zag BIT in the working memory 25 (F40) and the printing is effected (F41). The printing covers the area not completed in the previous scan. The zig-zag BIT sets the zig-zag pattern or the complementary zig-zag pattern which is set at the start of the printing of the scan.

After the scan, whether the last line flag is set or not is determined (F42). If it is not set, the sheet is fed by the number of lines stored in the memory area Pre-LINE in the working area 25 (F43). Thus, in the next printing, the printing may be effected from the point of current development. The timer 33 which monitors the time interval of the print data sent from the host apparatus is cleared and the timer is set to a predetermined time (F44) (10 seconds in the present embodiment), and a thinning pattern for the next printing is set in accordance with the content of the Pre-LINE (F45, F46).

If the content of the Pre-LINE is even, the zig-zag BIT is flipped to effect the next printing with the different thinning pattern from the current one, and if it is odd, the zig-zag BIT is kept unchanged to effect the next printing with the same thinning pattern as the current one. For example, if the current printing is by the zig-zag, the next printing is by the complementary zig-zag.

The number of print lines developed is stored in the Pre-LINE and the LINE is cleared (F47).

If the last line flag is set in F42, a counter in the working memory 25 is incremented by one (F48), whether the content of the counter is 2 or not is determined (F49), and if it is not, the process proceeds to F43 to conduct the same operation as that described above. If the content of the counter is equal to 2, the sheet is ejected (F50) and the last line flag and the counter are reset (F51).

When the predetermined signal is applied from the timer 33 to the interrupt port, the CPU 21 executes a timer routine. In the timer routine, when the preset time (10 seconds) is elapsed, a timeout flag is set (F30). If the flag is set during the reception of the data from the interface (F39), the printing of the received lines is effected even if the received data does not reach one scan (F41). In this case, the lines not printed in the previous scan are also printed. Then, whether it is the last line or not is determined as it is for the first scan printing (F42), and if it is not the last line, the sheet is fed by the number of print lines previously developed stored in the memory area Pre-LINE (F43) to be ready for the next printing. In this case, the timer is cleared, the time-out flag is reset and the timer is set again to the predetermined time (F44). Whether the number of lines previously developed is odd or even is determined (F45), and if it is odd, the zig-zag BIT is remained unchanged, and if it is even, the zig-zag BIT is flipped so that the printing of the newly developed print area is completed in the next printing.

If it is the last line, one scan is made as described above, the sheet is ejected (F50) and the last line flag and the counter are reset.

By the above operation, the dry condition of the ink previously printed is constant in the overprinting of the zig-zag and complementary zig-zag printing without regard to the speed of the processing time and the print data transfer rate of the host apparatus. As a result, the print density is kept constant and high grade image quality is attained.

Embodiment 4

Figures 14A, 14B:
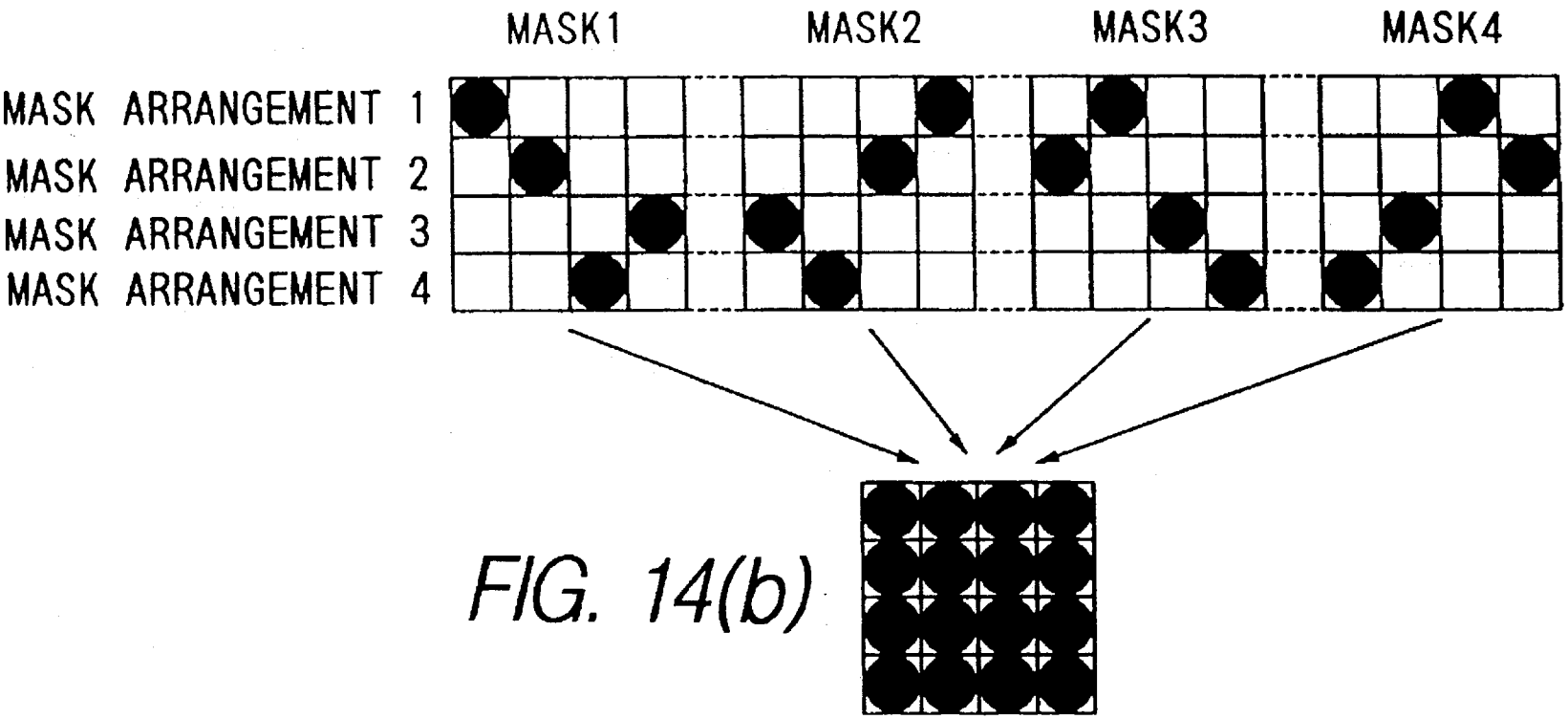
Figure 15:
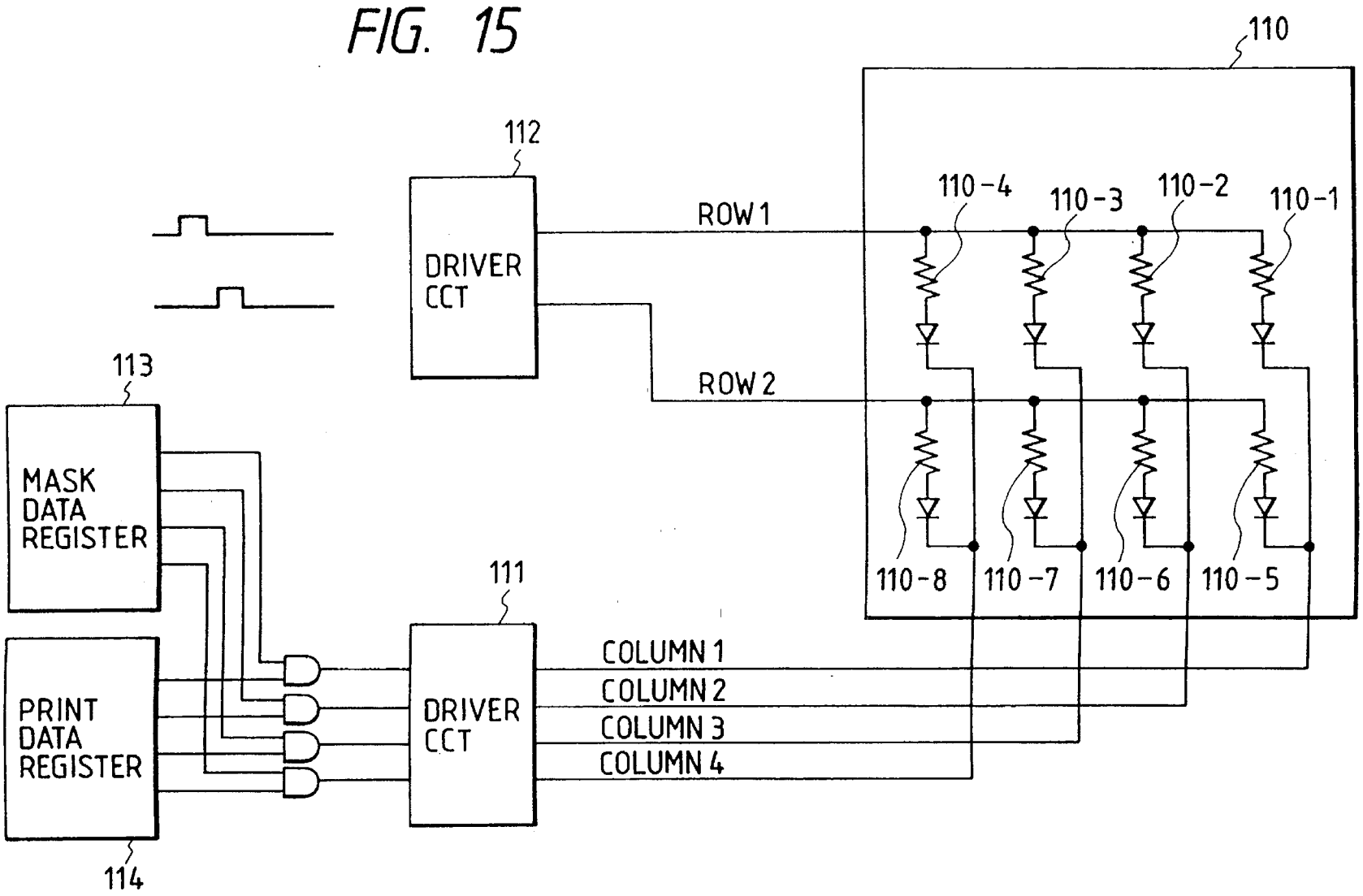
FIG. 15 shows a circuit diagram for printing by using the mask pattern shown in FIG. 14, FIGS. 16(*a*) through 16(*h*) show a timing chart in printing the mask pattern shown in FIG. 14.

A fourth embodiment of the present invention is now explained. In the present embodiment, a 4×4 mask pattern instead of the zig-zag and complementary zigzag patterns is used as a mask pattern in effecting the multi-pass printing. FIGS. 14(*a*) and (*b*) an example of the 4×4 mask pattern. This mask pattern is printed in four scans to attain a normal printout as shown in the bottom. An electric circuit which allows the printing with this mask pattern is shown in FIG. 15.

In this circuit, an 8-nozzle unit which is controlled by 4 rows by 2 columns diode matrix drive is used as a head unit. The head unit 110 is controlled by a combination of two row signals and four column signals and heaters 110-1 to 110-8 are energized by the respective combination to cause state change in the ink so that the ink is discharged to print data. For example, in order to energize all of the eight nozzles, the print data (1111) is set in a print data register 114 and a mask data register 113 and a signal Row1 is sent. When the heaters 110-1 to 110-7 corresponding to the nozzles are energized, a signal Row2 is sent without updating the data in the print data register 114. In this manner, the heaters 110-5 to 110-8 are energized.

Figures 16A, 16B, 16C, 16D, 16E, 16F, 16G, 16H:
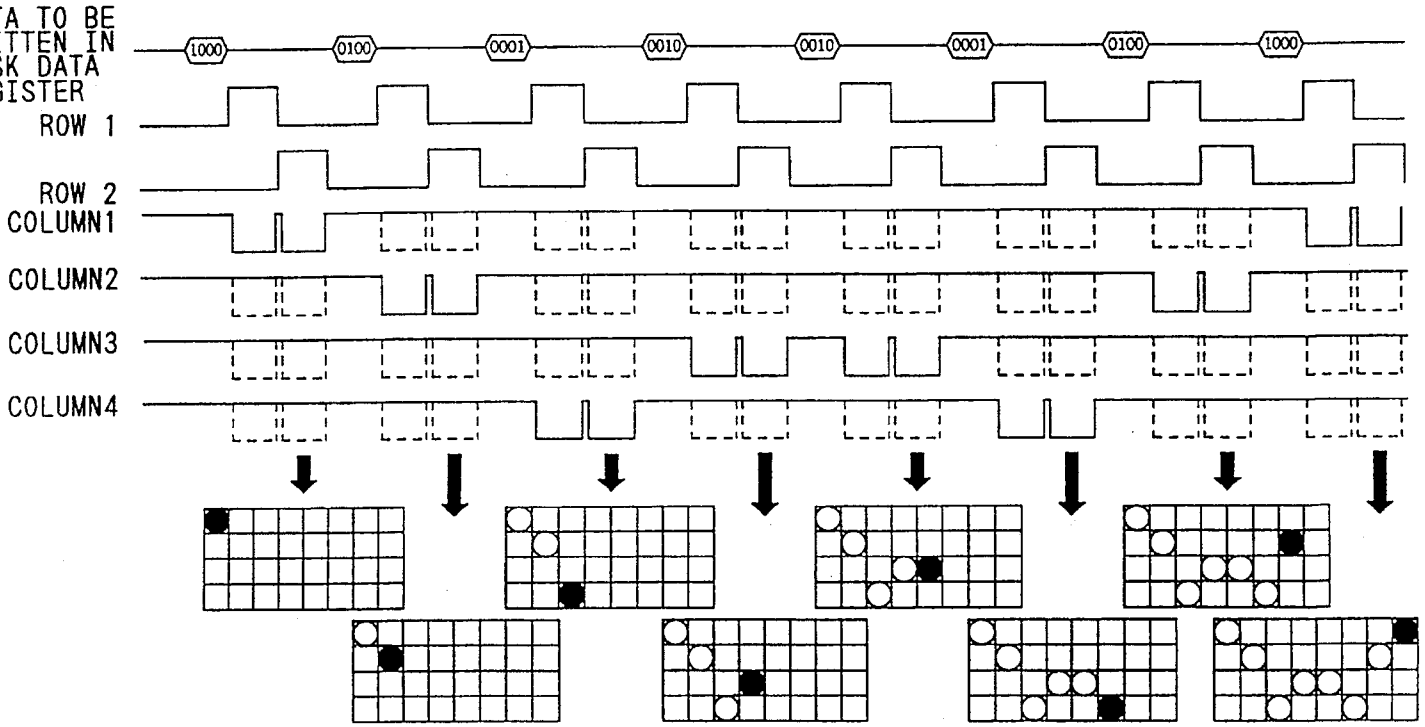

Any mask data may be set in the mask data register 113. The mask status is explained with reference to a timing chart of FIGS. 16(*a*) through 16(*h*). First, (1000) is written into the mask register 113. "1" represents data to be printed and "0" represents data to be masked. After the data has been written into the print register 114, the signals Row1 and Row2 are sent out in staggered manner. When different masks are to be applied to Row1 and Row2, it is necessary to update the setting of the mask data before the signal Row2 is sent. Thereafter, the mask data is written into the mask data register and the heaters are sequentially energized to attain the mask patterns MASK 1 and MASK 2 as shown below the arrow. Similarly, mask patterns MASK 3 and MASK 4 are attained by modifying the mask data.

Figures 17, 17A:
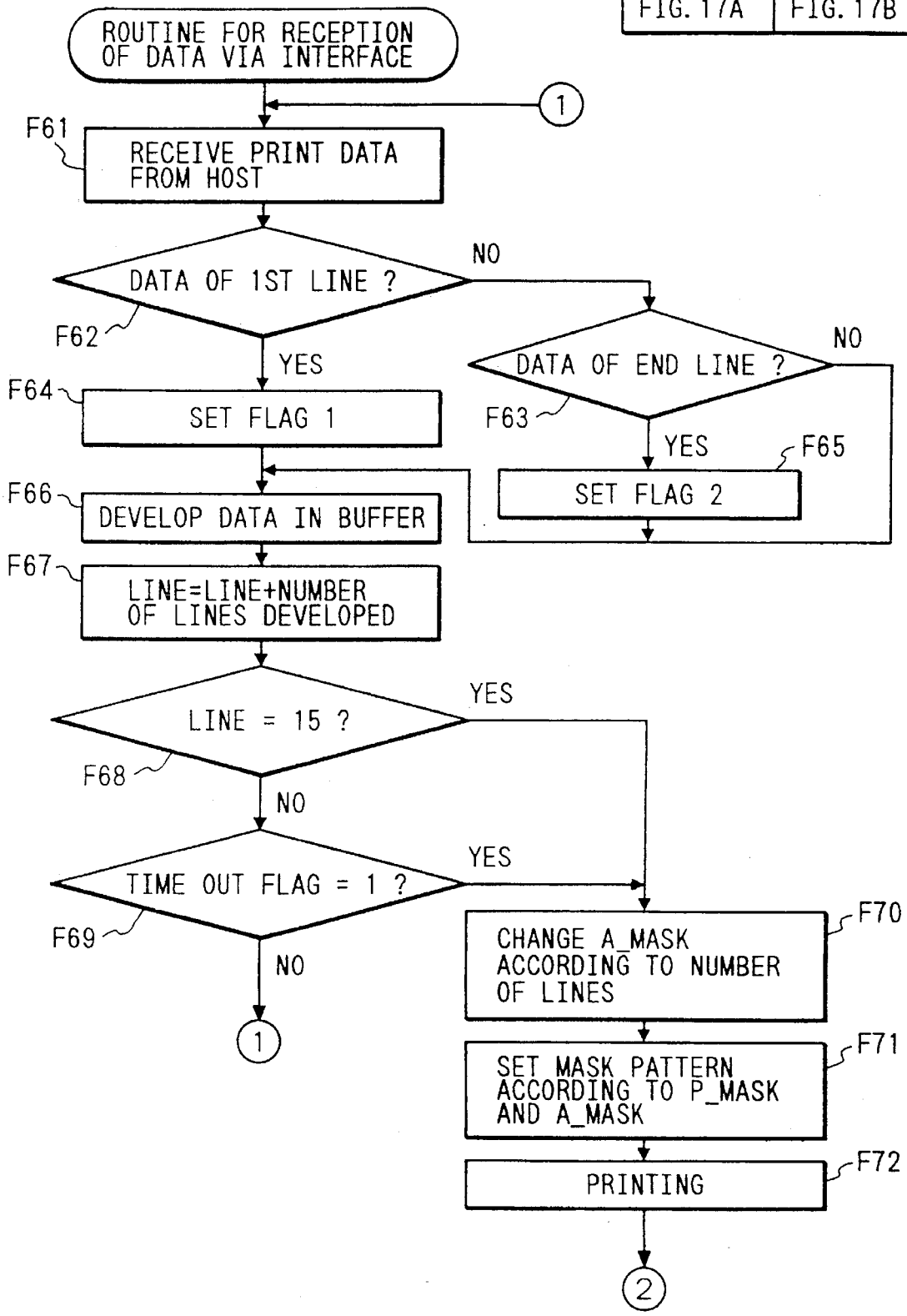
FIG. 17 is comprised of FIG. 17A and FIG. 17B showing control flow charts of the fourth embodiment of the present invention.
Figure 17B:
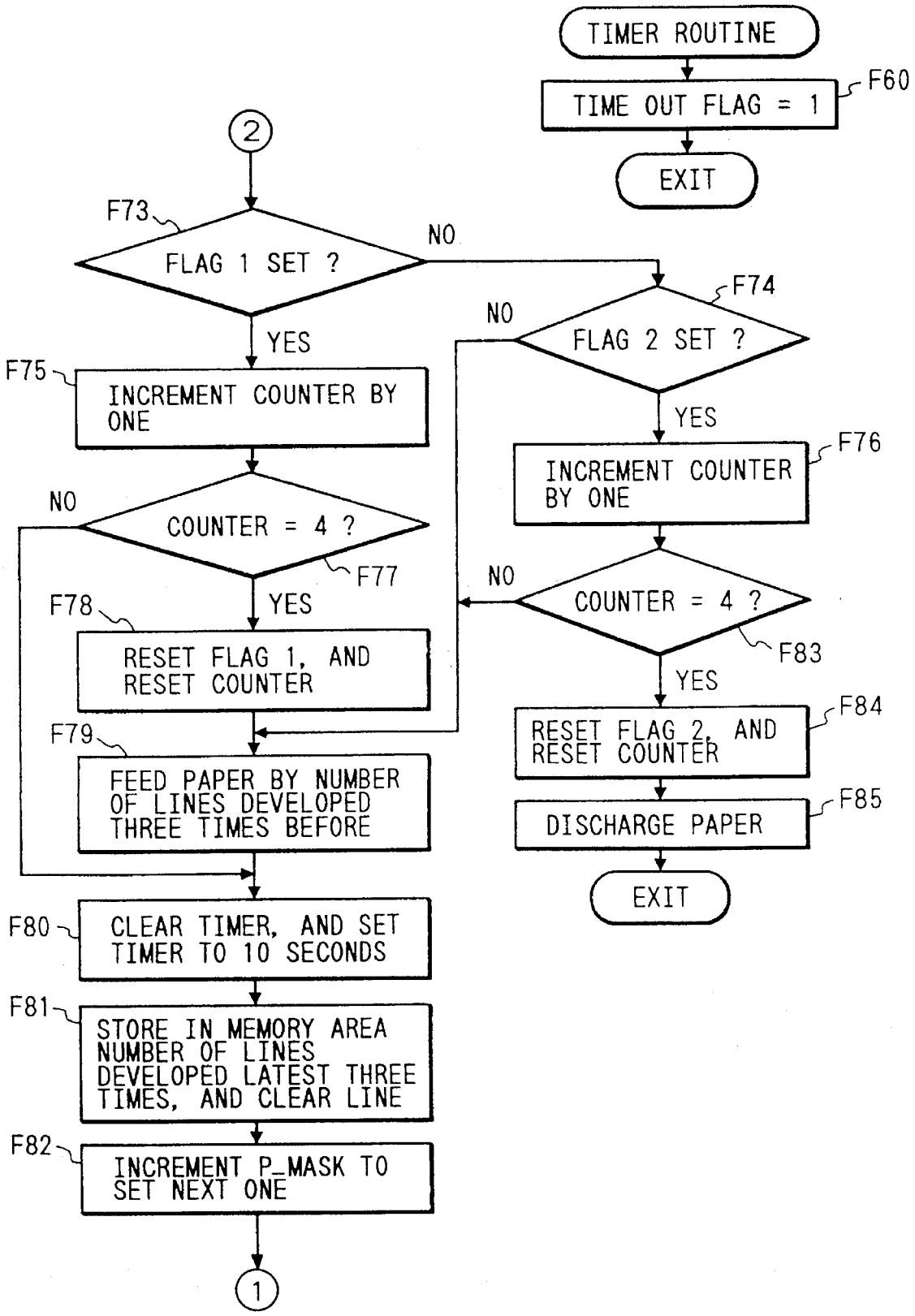

An example in which the present invention is applied to the 4×4 multi-pass printing described above is explained with reference to flow charts of Figs. 17A and 17B. After the initialization of the recording apparatus, the recording apparatus waits for the print data from the host apparatus. When it receives the print data from the host apparatus (F61), it determines whether it is first line data or not (F62), and if it is, a flag 1 in the working memory 25 is set (F64). If it is not the first line data, it determines if it is the last line data or not (F63). If it is, a flag 2 in the working memory 25 is set (F65). If it is neither the first line data nor the last line data, the process proceeds to F66.

In F66, the print data is developed into the data memory 23. The number of lines developed is stored in the memory area LINE in the working memory 25 (F67). When the developed lines in the data memory reach one quarter of scan (15 lines in FIG. 17A) (F68) mask array A_MASK is changed in accordance with the number of lines stored in the LINE, a mask pattern to be written into the mask data register 113 is determined in accordance with the mask pattern P_MASK and the mask array A_MASK (F71), and the scan is made to print the image (F72). The printing covers the area not completed in the previous scan. The mask pattern includes the MASK 1, MASK 2, MASK 3 and MASK 4 shown in FIG. 14, and the mask arrangement includes the mask arrays 1, 2, 3 and 4 of FIG. 14.

The scan is made in accordance with the mask pattern and the mask array determined in F71 to print the image (F72). Then, whether the flag 1 is set or not is determined (F73), and if it is, the content of the counter in the predetermined area in the working memory 25 is incremented by one and whether the content of the counter is 4 or not is determined (F75, F77). Before the content of the counter reaches 4, the sheet is not fed and the timer 33 which monitors the time interval of the print data sent from the host appratus is cleared and the predetermined time (10 seconds in the present embodiment) is set again (F80). The number of print lines developed in the latest three times is stored in the predetermined area in the working area 25 and the content of the memory area LINE is cleared (F81). The mask pattern P_MASK is incremented to set to the next one (F82) and the process returns to F61. When the count reaches 4, the flag 1 and the counter are reset (F78), and the sheet is fed by the number of lines developed in the three previous scans (F79). Then, the process proceeds to F80 and the same process as that described above is effected.

If the flag 1 is not set in F73, whether the flag 2 is set or not is determined (F74). If the flag 2 is not set, the sheet is fed by the number of lines developed in the previous three scans stored in the working memory 25 (F79). Then, the process proceeds to F80 et seq to conduct a similar process to that described above.

If the flag 2 is set in F74, the counter is incremented and whether the count is 4 or not is determined (F76, F83). Before it reaches 4, the process proceeds to F79 to conduct the same process as that described above. When the count reaches 4, it is decided that the recording is over and the flag 2 and the counter are reset (F84) and the sheet is ejected (F85).

When the predetermined signal is applied from the timer 33 to the interrupt port, the CPU 21 executes the timer routine. In the timer routine, when the preset time (10 seconds) is elapsed, the time-out flag is set (F60). When this flag is set during the reception of the data from the interface (F69), the received lines are printed even if the received print data does not reach one scan (F72). In this case, it is necessary to modify the content of the mask array A_MASK by the number of print lines developed. In the printing, the lines not completed in the previous scan are covered by setting the mask register by the contents of A_MASK and P_MASK (F71). After the printing, the process proceeds to F73 et al. and the sheet is fed by the print area developed in the three previous scans to be ready for the next printing. In this case, the timer is cleared, the time-out flag is reset, and the timer is set again to the predetermined time.

The operation of the mask array A_MASK may be eliminated by printing four lines at a time.

As described above, the scatter of density is avoided in the split recording without regard to the processing speed of the host apparatus and high grade image is attained.

In the above embodiments, the ink jet recording apparatus which utilizes the thermal energy to form the flying droplets to record the data has been described. A typical configuration thereof and a principle are disclosed in U.S. Pat. No. 4,723,129 and U.S. Pat. No. 4,740,796. The present system is applicable to either an on-demand type or a continuous type. In the on-demand type, at least one drive signal which causes a rapid temperature rise over a nuclear boiling point in accordance with recording information is applied to electro-thermal converters arranged on sheets by which liquid (ink) is held in order to generate the thermal energy in the electro-thermal converters to cause film boiling on a thermal acting plane of a recording head. As a result, bubbles of ink which directly correspond to the drive signal are formed. To form the bubbles, the liquid (ink) is discharged by contraction thorough the discharging orifice to form at least one droplet. When the drive signal is a pulse signal, the formation and the contraction of the bubble can be attained instantly and properly and highly responsible discharge of liquid (ink) is attained.

The drive by the pulse signal is disclosed in U.S. Pat. No. 4,463,359 and U.S. Pat. No. 4,345,262. When a condition disclosed in U.S. Pat. No. 4,313,124 relating to a temperature rise factor on the thermal acting plane is adopted, better recording can be attained.

The recording head may be a combination of discharge orifices, a liquid path and electro-thermal converters (linear liquid flow path or orthogonal liquid flow path) disclosed in the above patents, or a construction shown in U.S. Pat. No. 4,558,333 or U.S. Pat. No. 4,459,600 which discloses to arrange the thermal acting portion in a curved area.

Further, it may be a construction as disclosed in Japanese Laid-Open Patent Application No. 59-123670 in which a common slit to a plurality of electro-thermal converters is used as a discharge portion of the electro-thermal converters or Japanese Laid-Open Patent Application No. 59-138461 in which an aperture for absorbing a pressure wave of thermal energy is formed for the discharge portion.

The present invention is also applicable to a full line type recording head having a length equal to a maximum width of a recording medium on which the recording apparatus can print. Such a recording head may meet the length requirement by a combination of a plurality of recording heads or a single integral recording head.

The present invention is also applicable to a replaceable chip type recording head which, when it is mounted on the apparatus, permits the electrical connection with the apparatus and the supply of ink from the apparatus, or a cartridge type recording head having an ink tank integrally provided in the recording head.

It is preferable in further stabilizing the effect of the present invention to add recovery means and preliminary auxiliary means to the recording head. Specific examples are capping means for the recording head, cleaning means, pressurizing or suction means, preliminary heating means including a electro-thermal transducer, a separate heating element or a combination thereof, and preliminary discharge mode for discharging separately from the discharge for recording.

The record mode of the recording apparatus is not limited to one in which black is a principal color but multi-color of different colors or full color by the mixture of colors may be used by the combination of a plurality of integral recording heads.

In the embodiments of the present invention, the ink is described as liquid although it may be solidified at or below a room temperature, or softened or liquid at the room temperature. In the ink jet system, the ink may be temperature controlled in a range of 30°–70° C. to bring the viscosity of the ink to a stable discharge range. Accordingly, it is only necessary that the ink is in liquid state when the recording signal is applied.

In addition, the temperature rise by the thermal energy may be prevented by using it as the energy to change the state of the ink from solid to liquid or the ink which is solidified when it is left may be used to prevent the evaporation of the ink. In any case, the ink may have a property that it is liquidified by the thermal energy, for example, it is liquidified by the application of the recording signal of the thermal energy and discharged as the liquid ink or it starts to be liquidified when it reaches the recording medium. In this case, the ink may be held in recesses or via-holes of a porous sheet in solid state to face the electro-thermal transducer as disclosed in Japanese Laid-Open Patent Application No. 54-56847 or Japanese Laid-Open Patent Application No. 60-71260. In the present invention, the most effective way to the inks described above is to execute the film boiling system.

Further, the recording apparatus of the present invention may be a combined or stand-alone image output terminal of an information processing apparatus such as a word processor or a computer, or a copying machine combined with a reader, or a facsimile apparatus having a receive/transmit function.

The present invention is not limited to the ink jet system which uses the thermal energy but it is also applicable to an ink jet system which uses a piezo-electric element.

What is claimed is:

1. A recording apparatus comprising:

receive means for receiving print data;

store means for storing data received by said receive means;

a recording head for recording an image on a recording medium in accordance with data stored in said store means, said recording head having a plurality of recording elements each for ejecting ink, said recording elements being arranged on said recording head in a predetermined direction;

scanning means for performing a record scan by moving said recording head in a main scan direction different from the predetermined direction;

moving means for relatively moving said recording head and the recording medium in a sub-scan direction different from the main scan direction, after completion of the record scan by said scanning means, the record scan by said scanning means and the relative movement between said recording head and the recording medium by said moving means being alternately repeated, to thereby record an image on the recording medium;

timer means for counting a predetermined time; and control means for causing said recording head to record a predetermined amount of data, corresponding to an area recorded by one record scan using said plurality of recording elements, when the predetermined amount of data is stored in said store means, said control means causing said recording head to record data of a smaller amount than the predetermined amount stored in said store means when said timer means counts the predetermined time even before the predetermined amount of data is stored in said store means;

wherein a sub-scan directional width of an area where the data of a smaller amount is recorded is smaller than a sub-scan directional width of an area where the data of the predetermined amount is recorded, and wherein a distance of the relative movement between said recording head and the recording medium by said moving means after performing the record scan of the data of the smaller amount is shorter than that after performing the record scan of the data of the predetermined amount.

2. A recording apparatus according to claim 1 wherein said recording elements discharge ink to the recording medium in accordance with the print data.

3. A recording apparatus according to claim 2 wherein said recording elements cause a change in a state of the ink by using a thermal energy to discharge the ink.

4. A recording apparatus according to claim 1, wherein said moving means relatively moves said recording head and the recording medium in the sub-scan direction by a width corresponding to the recorded data after the recording by said recording head.

5. A recording apparatus according to claim 1, wherein said moving means relatively moves said recording head and the recording medium in the sub-scan direction by a width corresponding to the recorded area after the recording by one or a plurality of record scans.

6. A recording apparatus comprising:

receive means for receiving print data;

store means for storing data received by said receive means;

a recording head for recording an image on a recording medium in accordance with data stored in said store means, said recording head having a plurality of recording elements each for ejecting ink, said recording elements being arranged on said recording head in a predetermined direction;

scanning means for performing a record scan by moving said recording head in a main scan direction different from the predetermined direction;

moving means for relatively moving said recording head and the recording medium in a sub-scan direction different from the main scan direction, after completion of the record scan by said scanning means, the record scan by said scanning means and the relative movement between said recording head and the recording medium by said moving means being alternately repeated, to thereby record an image on the recording medium;

timer means for counting a predetermined time; and control means for causing said recording head to record a predetermined amount of data corresponding to an area recorded by one record scan using said plurality of recording elements when the predetermined amount of data is stored in said store means, and also causing said recording head to record data of a smaller amount than the predetermined amount stored in said store means when said timer means counts the predetermined time even before the predetermined amount of data is stored in said store means, said control means controlling the recording operation to complete the recording of an area on the recording medium by a plurality of times of record scans by using complementary thinning mask patterns to the area;

wherein a sub-scan directional width of an area where the data of a smaller amount is recorded is smaller than the sub-scan directional width of an area where the data of the predetermined amount is recorded, and wherein a distance of the relative movement between said recording head and the recording medium by said moving means after performing the record scan of the data of the smaller amount is shorter than that after performing the record scan of the data of the predetermined amount.

7. A recording apparatus according to claim 6 wherein said control means completes the recording of the predetermined area by n record scans by using n ($n \geqq 2$) complementary thinning mask patterns, and wherein said moving means relatively moves said recording head and the recording medium, by a width corresponding to the data recorded in the (n−1) previous record scans, after a record scan.

8. A recording apparatus according to claim 6, wherein said recording elements discharge ink to the recording medium in accordance with the print data.

9. A recording apparatus according to claim 8 wherein said recording elements cause a change in a state of the ink by using a thermal energy to discharge the ink.

* * * * *

UNITED STATES PATENT AND TRADEMARK OFFICE

CERTIFICATE OF CORRECTION

PATENT NO. : 5,610,634

DATED : March 11, 1997

INVENTOR(S) : TAKAYUKI MURATA, ET AL.

It is certified that error appears in the above-indentified patent and that said Letters Patent is hereby corrected as shown below:

COLUMN 1

Line 55, "by" should read --of--.

COLUMN 4

Line 63, "is" should be deleted.

COLUMN 9

Line 44, "is remained" should read --remains--.

COLUMN 11

Line 57, "thorough" should read --through--.

UNITED STATES PATENT AND TRADEMARK OFFICE

CERTIFICATE OF CORRECTION

PATENT NO. : 5,610,634

DATED : March 11, 1997

INVENTOR(S) : TAKAYUKI MURATA, ET AL.

It is certified that error appears in the above-indentified patent and that said Letters Patent is hereby corrected as shown below:

COLUMN 12

Line 31, "a" (first occurrence) should read --an--.

Line 42, "a" should be deleted.

Line 62, "way to" should read --way to discharge--.

Signed and Sealed this

Twentieth Day of January, 1998

*Attest:*

*Attesting Officer*

BRUCE LEHMAN

*Commissioner of Patents and Trademarks*